US007490483B2

(12) United States Patent
Boiarski et al.

(10) Patent No.: US 7,490,483 B2
(45) Date of Patent: Feb. 17, 2009

(54) EFFICIENT HEAT EXCHANGER FOR REFRIGERATION PROCESS

(75) Inventors: Mikhail Boiarski, Macungie, PA (US); Oleg Podtcherniaev, Odintsovo (RU); Kevin P. Flynn, Novato, CA (US)

(73) Assignee: Brooks Automation, Inc., Chelmsford, MA (US)

( * ) Notice: Subject to any disclaimer, the term of this patent is extended or adjusted under 35 U.S.C. 154(b) by 468 days.

(21) Appl. No.: 11/244,323

(22) Filed: Oct. 5, 2005

(65) Prior Publication Data

US 2006/0075775 A1 Apr. 13, 2006

Related U.S. Application Data

(60) Provisional application No. 60/616,873, filed on Oct. 7, 2004.

(51) Int. Cl.
*F25B 41/00* (2006.01)

(52) U.S. Cl. ..... 62/513; 62/476; 62/501; 62/515

(58) Field of Classification Search ..... 62/513, 62/515, 501, 476
See application file for complete search history.

(56) References Cited

U.S. PATENT DOCUMENTS

| | | | | |
|---|---|---|---|---|
| 3,407,875 | A | 10/1968 | Campbell | |
| 5,625,112 | A | 4/1997 | Ragi et al. | |
| 5,964,985 | A * | 10/1999 | Wootten | 201/40 |
| 6,502,410 | B2 | 1/2003 | Podtchereniaev et al. | |

FOREIGN PATENT DOCUMENTS

| | | |
|---|---|---|
| DE | 44 22 178 A1 | 6/1994 |
| EP | 0 865 818 A1 | 3/1998 |
| EP | 1 038 575 A2 | 2/2000 |

* cited by examiner

*Primary Examiner*—Melvin Jones
(74) *Attorney, Agent, or Firm*—Hamilton Brook Smith & Reynolds, PC

(57) ABSTRACT

Aspects of the invention are found in a heat exchanger. The heat exchanger includes a fluid inlet manifold, a fluid outlet manifold, a plurality of heat transfer channels configured to communicate with the fluid inlet manifold and the fluid outlet manifold, and packing located within the fluid inlet manifold. Further aspects of the invention are found in a refrigeration system. The refrigeration system includes a compressor and at least one heat exchanger coupled to the compressor. The at least one heat exchanger includes a header, packing located in the header, and a heat transfer channel. The heat transfer channel is configured to receive fluid passing through the header and the packing.

43 Claims, 6 Drawing Sheets

EFFICIENT HEAT EXCHANGER FOR REFRIGERATION PROCESS

RELATED APPLICATION

This application claims the benefit of U.S. Provisional Application No. 60/616,873, filed on Oct. 7, 2004, the entire teachings of which application are incorporated herein by reference.

BACKGROUND OF THE INVENTION

Low temperature and cryogenic refrigeration is typically used to cool fluid streams for cryogenic separations, trap water vapor to produce low vapor pressures in vacuum processes and to cool articles in manufacturing processes, such as semiconductor wafer processing, cooling of imaging detectors and radiation detectors, industrial heat transfer and biopharmaceutical and biomedical applications and biomedical storage, and chemical processing. A refrigeration cycle, generally, compresses a refrigerant gas, condenses the gas through an exchange of heat with a coolant and may further exchange heat with returning decompressed or expanded gas to achieve additional cooling. Often, portions of the refrigeration cycle have two-phase liquid/gas flow.

A typical refrigeration cycle may have one or more heat exchangers. These heat exchangers may act to condense compressed gas, absorb heat after expansion, or exchange heat between compressed fluid and returning expanded gas. Typical applications use shell and tube, tube in tube, or twisted tube heat exchange systems. Others use plate type heat exchangers.

Shell and tube, tube in tube, or twisted tube heat exchangers are inexpensive and exhibit low pressure drop, even in two-phase flow environments. However, tubular exchangers have a low surface area per unit volume or length of the exchanger. To achieve a desired heat transfer surface area, long extensions of tubing are used. In confined spaces, these heat exchangers are wrapped and contorted, increasing cost.

Plate type heat exchangers have a better surface area to volume ratio and are more compact. However, typical plate type heat exchangers are more expensive and are not efficient in two-phase flow environments, often exhibiting poor distribution of each phase between channels. Poor distribution leads to reduced stability, reduced heat exchanger effectiveness, reduced heat transfer coefficients, reduced system efficiency, increased pressure drop, and, in the case of ultra low and cryogenic temperature applications, can lead to freeze out conditions. On the other hand, typical two-phase flow distributors used in plate-type heat exchangers have a high pressure drop (greater than about 18 psi).

As such, an improved heat exchanger would be desirable.

SUMMARY OF THE INVENTION

Aspects of the invention are found in a heat exchanger. The heat exchanger includes a fluid inlet manifold, a fluid outlet manifold, a plurality of heat transfer channels configured to communicate with the fluid inlet manifold and the fluid outlet manifold, and packing located within the fluid inlet manifold.

In further, related embodiments, a fluid entering the fluid inlet manifold may comprise at least two phases, which may be vapor and liquid. The heat exchanger may be a plate-type heat exchanger, such as a counter-flow heat exchanger or short pass plate type heat exchanger. The packing may comprise packing elements, such as random packing elements or spherical balls; or may be selected from the group consisting of spherical elements, ellipsoidal elements, ring elements, cylindrical elements, saddle elements, spheroid elements, ribbon elements, and gauze elements. The packing elements may comprise at least two size modes, comprising at least a first set of packing elements having a first size mode and a second set of packing elements having a second size mode different from the first size mode. A dimension (such as the shortest dimension) of the packing elements may be greater than a width of one of the plurality of heat transfer channels. The heat exchanger may further comprise a structured element, located within the fluid inlet manifold, which may secure the packing. The structured element may be cylindrical; or may be conical, having a first end and a second end, the first end having a larger cross-section than the second end. The second end may be located proximate to a no-flow end of the inlet manifold, or may be located proximate to a flow end of the inlet manifold. The structured element may have a cross-sectional area that varies along a portion of its length. The pressure drop across the heat exchanger may be no more than 5 psi for a fluid velocity of 3 meters per second. The overall heat transfer coefficient of the heat exchanger may be improved by at least 2% by virtue of using a packing material in the header.

Additional aspects of the invention are found in a heat exchanger. The heat exchanger includes a plurality of parallel heat transfer plates defining a first set of fluid channels and at least a second set of fluid channels, a first fluid inlet port configured to communicate with the first set of fluid channels, a first fluid outlet port configured to communicate with the first set of fluid channels, a second fluid inlet port configured to communicate with the second set of fluid channels, a second fluid outlet port configured to communicate with the second fluid channels, and a packed distributor located within at least one of the first fluid inlet port and the second fluid inlet port. In some alternative configurations three or more fluid streams are cooled.

Further aspects of the invention are found in a refrigeration system. The refrigeration system includes a compressor and at least one heat exchanger coupled to the compressor. The at least one heat exchanger includes a header, packing located in the header, and a heat transfer channel. The heat transfer channel is configured to receive fluid passing through the header and the packing.

In further, related embodiments, the refrigeration system may include a mixed refrigerant. The header may be configured to receive a two-phase fluid. The refrigeration system may be configured to reach temperatures below 200K. The at least one heat exchanger may perform as a heat exchanger selected from the group consisting of a desuperheater, a condenser, heat exchanger that exchanges heat between at least two refrigerant streams, and an evaporator. The at least one heat exchanger may comprise a component in a refrigeration section. The refrigeration section may comprise a separator. The at least one heat exchanger may be a plate type heat exchanger, and may be horizontally or vertically oriented; and may be vertically oriented with a warm end up. The refrigeration system may include a single component refrigerant. The refrigeration system may also be a very low temperature refrigeration system; and may include a mixed refrigerant. The refrigeration system may be capable of operating in at least a cool mode and a standby mode; or at least a cool mode, a standby mode, and a defrost mode.

Aspects of the invention are also found in a method for exchanging heat. The method includes flowing a first fluid through a heat exchanger and flowing a second fluid through the heat exchanger. The heat exchanger includes a plurality of parallel heat transfer plates defining a first set of fluid channels and at least a second set of fluid channels, a first fluid inlet port configured to communicate with the first set of fluid channels, a first fluid outlet port configured to communicate with the first set of fluid channels, a second fluid inlet port configured to communicate with the second set of fluid channels, a second fluid outlet port configured to communicate with the second fluid channels, and a packed distributor located within at least one of the first fluid inlet port and the second fluid inlet port. The first fluid flows through the first fluid inlet port, the first set of fluid channels, and the first fluid outlet port. The second fluid flows through the second set of fluid channels. Heat is exchanged between the first fluid and the second fluid via the plurality of parallel heat transfer plates.

Additional aspects of the invention are found in a method of servicing a refrigeration system. The method includes inserting packing into a manifold of a heat exchanger associated with the refrigeration system. The heat exchanger includes the manifold and a heat transfer channel. The heat transfer channel is configured to receive fluid passing through the manifold and the packing.

Further aspects of the invention are found in a method of manufacturing a refrigeration system. The method includes inserting packing into a manifold of a heat exchanger associated with the refrigeration system. The heat exchanger includes the manifold and a heat transfer channel. The heat transfer channel is configured to receive fluid passing through the manifold and about the packing.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Refrigeration systems provide cooling in various applications. Some applications utilize ultra-low and cryogenic temperatures, typically below 230 K, such as not more than 230 K, not more than 183 K or not more than 108K. Refrigeration arrangements such as cascaded arrangements and autocascade cycles may be used to achieve low desired temperatures. These refrigeration systems utilize one or more heat exchangers to eject heat from one part of the refrigeration cycle and absorb heat in another part of the refrigeration cycle.

Figure 1:
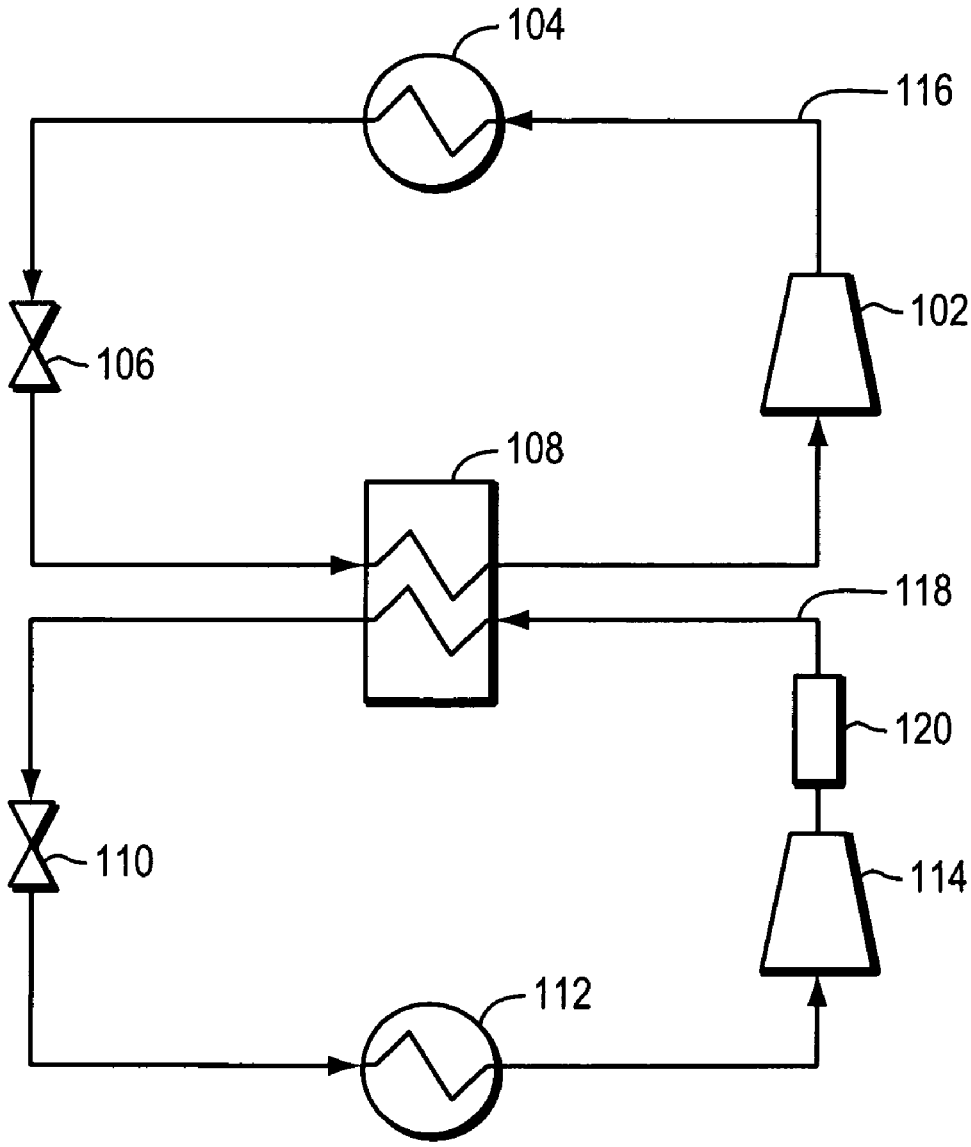
FIG. 1 depicts an exemplary embodiment of a cascade refrigeration system.

FIG. 1 depicts an exemplary refrigeration system having a first refrigeration cycle 116 and a second refrigeration cycle 118. The first refrigeration cycle 116 and the second refrigeration cycle 118 are arranged in a cascade configuration in which the first refrigeration cycle 116 cools the second refrigeration cycle through heat exchanger or condenser 108.

The refrigerant in the first refrigeration cycle 116 is compressed by compressor 102. The compressed refrigerant is cooled in heat exchanger or condenser 104 to condense the refrigerant. The condensed refrigerant is expanded through expander 106 and heated in heat exchanger 108 to vaporize the refrigerant. The vaporized refrigerant is returned to compressor 102.

In the second refrigeration cycle 118, a second refrigerant is compressed by compressor 114. The compressed second refrigerant is cooled to room temperature by desuperheater 120 and then is condensed in heat exchanger 108. By substantially vaporizing the first refrigerant in heat exchanger 108, the second refrigerant is condensed. The condensed second refrigerant is expanded in expander 110 and heated in heat exchanger 112, vaporizing the second refrigerant. The expanders 106 and 110 may be valves, capillary tubes, turbine expanders, or pressure drop plates. The vaporized second refrigerant is returned to compressor 114.

Heat exchanger 112 may be used to cool a process or article. The heat exchanger 112 may, for example, cool a heat transfer medium, a heat sink, or an article. The article may be cooled indirectly by using the heat transfer medium or heat sink. In one exemplary embodiment, the article is a semiconductor wafer. In another exemplary embodiment, heat exchanger 112 may cool a gas stream to, for example, condense water vapor. In a further exemplary embodiment, heat exchanger 112 may be used to cool a stream for use in cryogenic separations. In yet another exemplary embodiment heat exchanger 112 is used to cool a cryocoil in a vacuum pumping system. In still other exemplary embodiments, heat exchanger 112 is used to cool a biomedical freezer, is used to cool a detector, or is used to exchange heat with an industrial process, a chemical process or formulation of a pharmaceutical substance.

The heat exchangers 104, 108, 112, and 120 may, for example, be plate type heat exchangers, tube in tube heat exchangers, or shell and tube heat exchangers. The heat exchanger may, for example, include packing or a packed distributor in one or more manifolds feeding the heat exchangers.

The first refrigerant may be a single component or mixed refrigerant that includes one or more components selected from chlorofluorocarbons, hydrochlorofluorocarbons, fluorocarbons, hydrofluorocarbons, fluoroethers, hydrocarbons, atmospheric gases, noble gasses, low-reactive components, cryogenic gases, and combinations thereof. Similarly, the second refrigerant may be a single component or mixed refrigerant that includes one or more components selected from chlorofluorocarbons, hydrochlorofluorocarbons, fluorocarbons, hydrofluorocarbons, fluoroethers, hydrocarbons, atmospheric gases, noble gasses, low-reactive components, cryogenic gases, and combinations thereof. For such mixtures, the presence of two phases (a liquid phase plus a vapor phase) is very common throughout the refrigeration process since mixtures containing components with widely spaced boiling points (typically with 50 K or 100 K difference from warmest to coldest boiling components) are difficult to condense or evaporate entirely. Therefore, such mixtures will benefit greatly from this packed manifold. However, this packed manifold may benefit any process that has a two phase mixture entering the types of heat exchangers disclosed herein.

Exemplary embodiments of the first refrigerant may include refrigerants such as those described in U.S. Pat. Nos. 6,502,410, 5,337,572, and PCT Patent Publication No. WO 02/095308 A2, which are included herein in their entirety.

Figure 2:
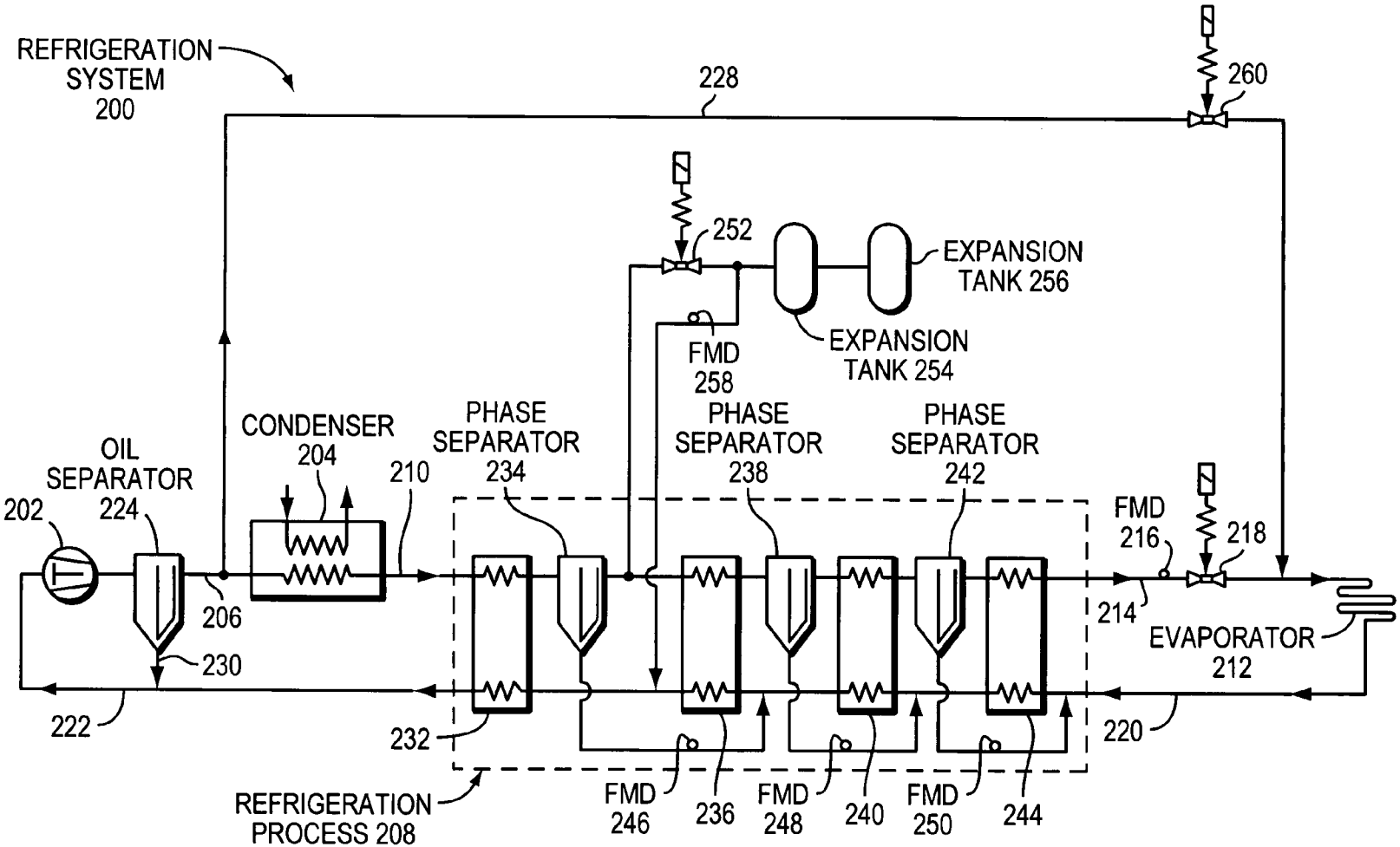
FIG. 2 illustrates an exemplary embodiment of an autocascade refrigeration cycle.

Either or both of the first and second refrigeration cycles of FIG. 1 may be autocascade cycles. FIG. 2 depicts an exemplary autocascade cycle with defrost capability. A refrigerant is compressed in compressor 202. The compressed refrigerant passes through an optional oil separator 224 to remove lubricant from the compressed refrigerant stream. Oil separated by the oil separator 224 may be returned to the suction line 222 of the compressor 202 via transfer line 230. Use of oil separator 224 is optional depending on the amount of oil ejected into the discharge stream and the tolerance of the refrigeration process for oil. In an alternative arrangement, oil separator 224 is located inline with defrost branch line 228.

The compressed refrigerant is passed from the oil separator 224 through line 206 to condenser 204 where the compressed refrigerant is at least partially condensed, resulting in two-phase liquid/vapor flow. A cooling medium may be used to condense the compressed refrigerant. In the case of a cascade configuration, a first refrigerant may be used to condense a second refrigerant in condenser 204.

From condenser 204, the condensed or partially condensed refrigerant is transferred through line 210 to the refrigeration process 208. The refrigeration process 208 may include one or more heat exchangers, phase separators, and flow metering devices. A cooled outlet 214 of refrigeration process 208 is directed to the evaporator 212, which cools a process or article by absorbing heat from the process or article. The heated refrigerant is returned to the refrigeration process 208 via line 220. In a cascade arrangement evaporator 212 is used to cool the refrigerant in the next colder stage. In alternative embodiments according to the invention, various service valves (not shown) may be included in the embodiment of FIG. 2, as will be appreciated by those of skill in the art.

In the exemplary embodiment of FIG. 2, refrigeration process 208 is shown as an auto-refrigerating cascade system and includes a heat exchanger 232, a phase separator 234, a heat exchanger 236, a phase separator 238, a heat exchanger 240, a phase separator 242, a heat exchanger 244, a flow metering device (FMD) 246, an FMD 248, and an FMD 250. The heat exchangers provide heat transfer from the high pressure refrigerant to the low pressure refrigerant. The FMDs throttle the high pressure refrigerant to low pressure and create a refrigeration effect as a result of the throttling process.

The heat exchangers 232, 236 and 240 and evaporator 212 and condenser 204 may, for example, be plate type heat exchangers, tube in tube heat exchangers, or shell and tube heat exchangers. The heat exchanger may, for example, include packing or a packed distributor in one or more manifolds feeding the heat exchangers.

Refrigeration system 200 can operate in one of three modes, cool, defrost and standby. The described refrigerant mixtures enable operation in each of these three modes. If solenoid valves 260 and 218 are both in the closed position, the system is said to be in standby. No refrigerant flows to the evaporator. Refrigerant flows only within the refrigeration process 208 by means of the internal flow metering devices (i.e., FMD 246, FMD 248, and FMD 250), which cause high pressure refrigerant to be delivered to the low pressure side of the process. This permits continuous operation of the refrigeration process 208. In the case where a single throttle refrigeration process is used, a standby mode of operation is only possible if a means of causing flow to go through a throttle is available during the standby mode to cause the refrigerant to flow from the high pressure side to the low pressure side of the refrigeration process 208. In some arrangements, standby mode may be enabled by a pair of solenoid valves to control the flow of refrigerant to the evaporator or back to the refrigeration process. In other arrangements, an additional throttle and a solenoid valve are used to enable this internal flow in standby.

In an alternative arrangement, a heat exchanger, referred to as a subcooler (for example, such as the subcooler of FIG. 3, below), is included in the refrigeration process. The subcooler diverts a fraction of high-pressure refrigerant from the evaporator and expands it to low pressure to lower the refrigerant temperature. This stream is then use to precool the entire flow that feeds both the evaporator and this diverted flow. Thus when flow to the evaporator is stopped, internal flow and heat transfer continues allowing the high pressure refrigerant to become progressively colder. This in turn results in colder temperatures of the expanded refrigerant entering the subcooler.

Figure 3:
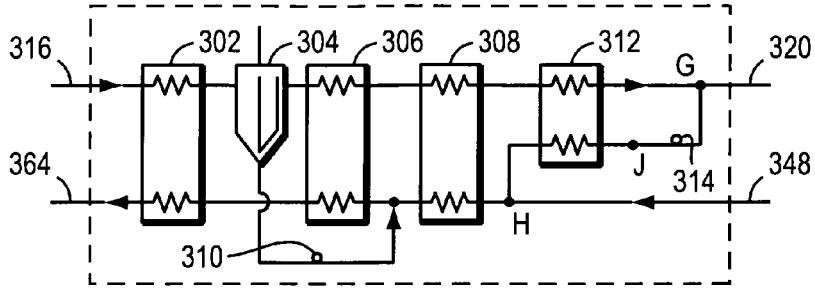
FIG. 3 depicts an exemplary embodiment of a refrigeration system.

As shown in FIG. 3, heat exchanger 312 is known as a subcooler. Some refrigeration processes do not require it and therefore it is an optional element. If heat exchanger 312 is not used then the high pressure flow exiting heat exchanger 308 directly feeds refrigerant supply line 320. In the return flow path, refrigerant return line 348 feeds heat exchanger 308. In systems with a subcooler, the low pressure refrigerant exiting the subcooler is mixed with refrigerant return flow at node H and the resulting mixed flow feeds heat exchanger 308. Low pressure refrigerant exiting heat exchanger 308 feeds heat exchanger 306. The liquid fraction removed by the phase separator 304 is expanded to low pressure by an FMD 310. Refrigerant flows from FMD 310 and then is blended with the low pressure refrigerant flowing from heat exchanger 308 to heat exchanger 306. This mixed flow feeds heat exchanger 306 which in turn feeds heat exchanger 302, which subsequently feeds compressor suction line 364. The heat exchangers exchange heat between the high pressure refrigerant and the low pressure refrigerant.

Returning to FIG. 2, by opening solenoid valve 218 the system is in the cool mode. In this mode of operation solenoid valve 260 is in the closed position. Very low temperature refrigerant from the refrigeration process 208 is expanded by FMD 216 and flows through valves 218 and out to the evaporator 212 and is then returned to refrigeration process 208 via refrigerant return line 220.

Refrigeration system 200 is in the defrost mode by opening solenoid valve 260. In this mode of operation, solenoid valve 218 is in the closed position. In defrost mode hot gas from compressor 202 is supplied to evaporator 212. Typically defrost is initiated to warm the surface of evaporator 212. Hot refrigerant flows through the oil separator 224, to solenoid valve 260 via defrost line 228, is supplied to a node between solenoid valve 218 and evaporator 212 and flows to evaporator 212. In the beginning of defrost, evaporator 212 is at very low temperature and causes the hot refrigerant gas to be cooled and fully or partially condensed. The refrigerant then returns to the refrigeration process 208 via refrigerant return line 220. The returning defrost refrigerant is initially at very low temperature quite similar to the temperatures normally provided in the cool mode. As the defrost process progresses evaporator 212 is warmed. Ultimately the temperature of the returning defrost gas is much warmer than provided in the cool mode. This results in a large thermal load on refrigeration process 208. This can be tolerated for brief periods of time, typically 2-7 minutes, which is typically sufficient for warming the entire surface of evaporator 212. A temperature sensor, not shown for clarity, may be in thermal contact to refrigerant return line 220. When the desired temperature is reached at refrigerant return line 220, the temperature sensor causes the control system (not shown for clarity) to end defrost, closing the solenoid valve 260 and putting refrigeration system 200 into standby. After the completion of defrost, a short period in standby, typically 5 minutes, is required to allow the refrigeration process 208 to lower its temperature before being switched into the cool mode.

For the purposes of illustration in this disclosure, refrigeration process 208 of refrigeration system 200 is shown in FIG. 2 as one version of an auto-refrigerating cascade cycle. However, refrigeration process 208 of very low temperature refrigeration system 200 is any very low temperature refrigeration system, using mixed refrigerants. More generally, an embodiment according to the invention relates to refrigeration systems that provide refrigeration at temperatures between 233 K and 53 K (−40 C and −220 C). The temperatures encompassed in this range are variously referred to as low, ultra low, and cryogenic. For purposes of this application the term "very low" or "very low temperature" will be used to mean the temperature range between 233 K and 53 K (−40 C and −220 C). Further, for purposes of this application the term "mixed refrigerant" will be used to mean a refrigerant mixture including at least two components whose normal boiling points vary by at least 50 C from the warmest boiling component to the coldest boiling component. With terms defined as such, an embodiment according to the invention relates to a very low temperature refrigeration system using a mixed refrigerant, and to a heat exchanger used in such a refrigeration system.

More specifically, refrigeration process 208 may be a system with multiple phase separators, a single phase separator, or no phase separator.

Examples of systems with multiple phase separators, which may be used in an embodiment of the invention, are Missimer type cycle systems (i.e. auto-refrigerating cascade systems, as described in U.S. Pat. No. 3,768,273 of Missimer), also known as a Polycold® cryocooler system or fast cycle cryocooler system (i.e. auto-refrigerating cascade process). Examples of the Polycold system and related variations are described in U.S. Pat. No. 4,597,267 of Forrest and U.S. Pat. No. 4,535,597 of Missimer. Alternatively, any very low temperature refrigeration process with none, one, or more than one stage of phase separation may be used.

Examples of systems with one phase separator, which may also be used, were first described by Kleemenko.

Examples of systems with no phase separators, which may also be used, are the CryoTiger or PCC system (manufactured by Helix Polycold Systems Inc., Petaluma, Calif.), and are also known as single-stage cryocoolers having no phase separation. Such devices are described in U.S. Pat. No. 5,441,658 of Longsworth.

A further reference for low temperature and very low temperature refrigeration can be found in Chapter 39 of the 1998 ASHRAE Refrigeration Handbook produced by the American Society of Heating, Refrigeration, and Air Conditioning Engineering. In addition to the number of phase separators used, the number of heat exchangers, and the number of internal throttle devices used can be increased or decreased in various arrangements as appropriate for the specific application. All of the above-cited references are incorporated herein by reference.

Further variations of the refrigeration cycle include refrigeration processes used to cool or liquefy a gas stream. In some arrangements, the evaporator is used to cool or liquefy the gas. In other arrangements, the gas stream is precooled by use of a heat exchanger with at least three flow paths in which the returning low pressure refrigerant cools the high pressure refrigerant and at least one gas stream. In some cases, the function of the evaporator and this prechilling heat exchanger are combined. In this arrangement, high pressure refrigerant is expanded and then returned directly to the three flow heat exchanger. In yet other variations, plural gas streams are cooled or liquefied. Other variations of the refrigeration cycle may include refrigeration processes used to cool or liquefy a liquid stream (or plural liquid streams).

Several basic variations of refrigeration process 208 shown in FIG. 2 are possible. The refrigeration system 200 shown in FIG. 2 associates with a single compressor. However, it is recognized that this same compression effect can be obtained using two compressors in parallel, or that the compression process may be broken up into stages via compressors in series or a two-stage compressor. All of these possible variations are considered to be within the scope of this disclosure. The shown embodiment uses a single compressor since this offers improvements in reliability. Use of two compressors in parallel is useful for reducing energy consumption when the refrigeration system is lightly loaded. A disadvantage of this approach is the additional components, controls, required floor space, and cost, and reduction in reliability. Use of two compressors in series provides a means to reduce the compression ratio of each stage of compression. This provides the advantage of reducing the maximum discharge temperature reached by the compressed refrigerant gas. However, this too requires additional components, controls and costs and lowers system reliability. The shown embodiment uses a single compressor. With a single compressor, the compression of the mixed refrigerants in a single stage of compression may be used without excessive compression ratios or discharge temperatures. Use of a compressor designed to provide multistage compression and which enables cooling of refrigerant between compression stages retains the benefit of separate compression stages while minimizing the disadvantages of increased complexity since a single compressor is still used.

The phase separators may take various forms including coalescent-type, vortex-type, demister-type, or combination of these forms. The phase separators may include coalescent filters, knitted mesh, wire gauze, and structured materials. Depending on the design, flow rate, and liquid content, the phase separator may operate at efficiencies greater than 30%, and may be greater than 85% or in excess of 99%.

The refrigeration system 200 shown in FIG. 2 associates with a single evaporator. A common variation is to provide independent control of defrost and cooling control to multiple evaporators. In such an arrangement the evaporators are in parallel, each having a set of valves such as 260 and 218 to control the flow of cold refrigerant or hot defrost gas, and the connecting lines. This arrangement makes it possible to have one or more evaporators in the cool, defrost or standby mode, for example, while other evaporators may be independently placed in the cool, defrost or standby mode.

Refrigeration system 200 further includes an optional solenoid valve 252 fed by a branch from first outlet of phase separator 234. An outlet of solenoid valve 252 feeds an optional expansion tank 254 connected in series (shown) or in parallel (not shown) with a second expansion tank 256. Additionally, an inlet of an optional FMD 258 connects at a node between solenoid valve 252 and expansion tank 254. An outlet of FMD 258 feeds into the refrigerant return path at a node between heat exchanger 236 and heat exchanger 232. Various arrangements of system components may be used.

These arrangements included systems with passive expansion tank, systems in which a solenoid valve opens during start-up to store gas in the expansion tank, and bypass valves used to manage system performance during start-up as disclosed in U.S. Pat. No. 4,763,486 and in U.S. Pat. No. 6,644,067. Still other arrangements may be used which include no expansion tank and no special start-up arrangements as disclosed by Longsworth in U.S. Pat. No. 5,441,658. For this reason, use of an expansion tank is optional.

At start up, most of the refrigerants throughout refrigeration system 200 are typically in a gas state since the entire system is at room temperature. It is important to manage the refrigerant gas such that the cool down time is reduced. Selectively removing gas from circulation in refrigeration system 200 during startup is beneficial toward this time reduction. Additionally, the rate at which the gasses are bled back into refrigeration system 200 also affects the cool down rate.

The system controller (not shown) opens solenoid valve 252 briefly on startup, typically for 10 to 20 seconds. Solenoid valve 252 is, for example, a Sporlan model B6 valve. As a result, during startup, refrigerant gas exits from phase separator 234 and feeds the series combination of expansion tank 254 and expansion tank 256. FMD 258 regulates the flow of refrigerant gas in and out of expansion tanks 254 and 256. Two considerations for setting the flow through FMD 258 are as follows: the flow must be slow enough such that the gas returning to refrigeration system 200 is condensable in the condenser at whatever operating conditions exist at any given time, thereby insuring faster cool down. It is this initial formation of liquid during the start up process that enables cool down times on the order of 15-60 minutes. At the same time, however, the rate of flow through FMD 258 must be fast enough to insure that enough refrigerant is flowing in refrigeration system 200 such that a possible shutdown due to low suction pressure is prevented. The flow of gas to and from expansion tanks 254 and 256 is controlled passively using FMD 258 as shown in FIG. 2. Alternatively, a controller in combination with sensors can be used to provide active flow control. The arrangement of expansion tanks comprise at least one pressure vessel and could have any number or combination of expansion tanks arranged in series and or parallel. In alternate arrangements, the formation of liquid in the condenser, either during system cool down or during continuous operation, is not required. In these cases a slower rate of re-introduction of gases is sufficient, providing that an unacceptably low suction pressure does not develop.

Figure 4:
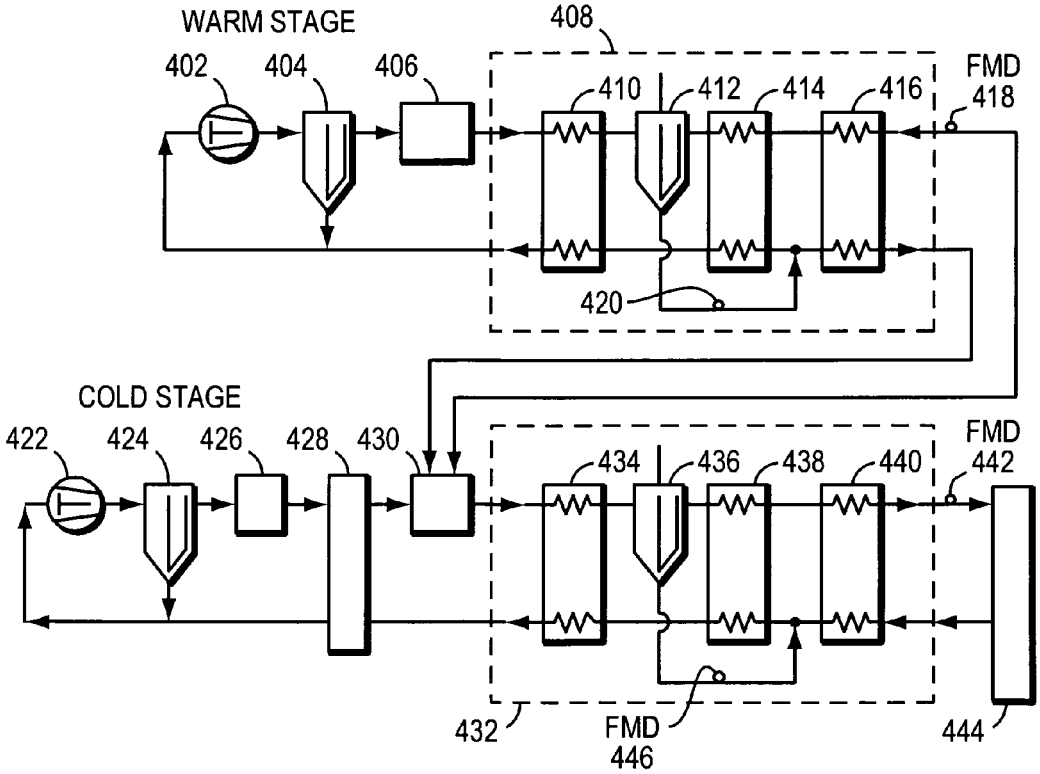
FIG. 4 depicts an exemplary embodiment of a refrigeration section.

FIG. 4 depicts a two-stage refrigeration system. The first stage is a warm stage that cools the second stage or cool stage. The second stage in turn cools a process or article through an evaporator or heat exchanger 444.

In the first stage, a compressor 402 compresses a first refrigerant. The compressed refrigerant passes through an optional oil separator 404 in which entrained oil may be removed and returned to the compressor. The compressed refrigerant is transferred to a condenser 406 where the compressed refrigerant condenses to a liquid form. The condensed refrigerant passes into a refrigeration section 408.

This refrigeration section 408 may include one or more heat exchangers. The refrigeration section 408 may also include one or more phase separators and flow metering devices (FMDs) or expanders. In the example shown, the refrigeration section 408 includes three heat exchangers 410, 414, 416, a phase separator 412, and an FMD 420. The expanded refrigerant is used to remove heat from heat exchanger 430 and is then returned to refrigeration section 408 and then passes through heat exchangers 410, 414, 416 through which heat is exchanged from the compressed or condensed refrigerant to the low pressure refrigerant returning to the compressor 402. Phase separator 412 and FMD 420 may be used to create a further refrigeration effect as a result of the pressure drop or expansion, and mixing of the different composition with returning flow.

FMD 418 may be used on the outlet of the refrigeration section to control refrigerant flow. FMD 418 may be closed, allowing the refrigeration cycle to cycle independently. Alternately FMD 418 may be opened allowing condensed refrigerant to expand into heat exchanger 430. In one exemplary embodiment, the first refrigerant may evaporate in heat exchanger 430, while the second refrigerant condenses.

In the second stage or cold stage, the second refrigerant is compressed in compressor 422. The compressed refrigerant may pass through an optional oil separator 424 to remove entrained oil. The compressed refrigerant may pass through an after cooler 426 to partially cool the compressed refrigerant. In an alternate embodiment, the arrangement of the after cooler 426 and the oil separator may be reversed. The compressed refrigerant may also pass through a heat exchanger 428 to further cool the compressed refrigerant and partially heat the low pressure refrigerant returning to the compressor suction line. The compressed refrigerant may then pass through condenser or heat exchanger 430, where heat is exchanged with the first refrigeration cycle. The condensed or partially condensed refrigerant may then pass into a refrigeration section 432 for further cooling. The cooled refrigerant is expanded through FMD 442 into an evaporator 444 to cool a process or article.

The refrigeration section 432 including heat exchangers 434, 438, 440, phase separator 436, and FMD 446 may operate in a similar manner to refrigeration section 408. Alternately, various configurations may be used in the refrigeration section 432.

The heat exchangers 406, 410, 414, 416, 426, 428, 430, 434, 438, 440, and 444 may, for example, be plate type heat exchangers, tube in tube heat exchangers, or shell and tube heat exchangers. The heat exchanger may, for example, include packing or packed distributors in one or more manifolds feeding the heat exchangers.

The refrigeration section may also include any of the system variations discussed for refrigeration system 208.

Figure 5:
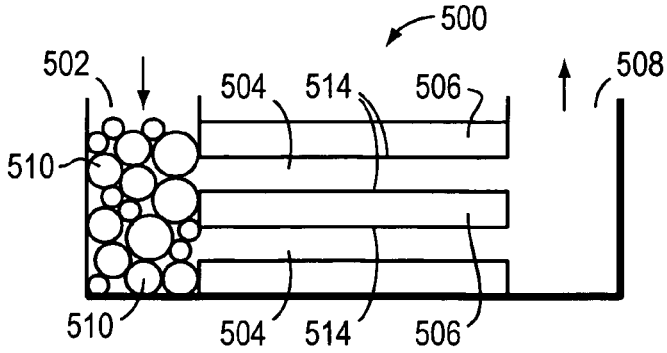
FIGS. 5 and 6 depict exemplary embodiments of heat exchangers.

FIG. 5 depicts an exemplary heat exchanger 500. The heat exchanger includes an input manifold or header 502 for receiving a first fluid. The input manifold 502 feeds a first set of one or more channels 504. The channels 504 may be separated from a second set of channels 506 carrying a second fluid by heat transfer surfaces 514. The channels 504 may communicate the first fluid to an outlet manifold or header 508. FIG. 5 illustrates a two stream heat exchanger. However, this invention may also be applied to heat exchangers with more than two flow streams.

In one exemplary embodiment, the heat exchanger 500 is a plate type heat exchanger. In one exemplary embodiment, the plate-type heat exchanger may have a set of parallel plates coupled to four manifolds in such a manner as to form two sets of channels. In one embodiment, the plate type heat exchanger may be a short-pass plate type heat exchanger; for example, a plate type heat exchanger in which the length to width ratio of the plate type heat exchanger is no more than 8.0, or no more than 6.0, or any other short-pass type heat exchanger. To achieve a desired heat transfer surface area, more than one heat exchanger may be connected in series or in a sequence for tandem operation. Further, more than one heat exchanger may be coupled in series with interspersed liquid separators to form a refrigeration section. In a further exemplary embodiment, the plate type heat exchanger may be a counter-flow plate type heat exchanger in which heat exchange fluids flow in opposite directions. Exemplary embodiments of plate type heat exchangers include Swep, Inc. B15 and Flat-Plate FP2×8-40 plate type heat exchangers. In an alternate embodiment, the heat exchanger 500 may be a shell and tube heat exchanger or tube in tube heat exchanger with multiple tubes.

The exemplary heat exchanger of FIG. 5 includes packing 510 in the input manifold 502. The packing forms a flow distributor. The packing 510 may be a random or structured packing. For example, the random packing may be packing that is arranged randomly when placed in the manifold. The packing depicted includes spherical balls. Alternately, the random packing may include rings, cylinders, saddles, hollowed spheroids, gauze or mesh pieces, or combinations of these. Packing of different sizes and shapes may be utilized together in a single manifold. In general it is preferred to fix the packing securely so that it will not move during shipping or operation. In a particular embodiment, the size of the random packing may be greater than the width of the channels 504 and should not exceed 99% of the width of the header, or of the opening connecting to the header. For example, the diameter of a spherical or cylindrical packing element may be greater than the width of a plate type heat exchanger channel. In cases where smaller packing elements are needed, a retaining structure such as a wire mesh or screen can be used to prevent the packing material from entering or blocking the flow passages.

Figure 6:
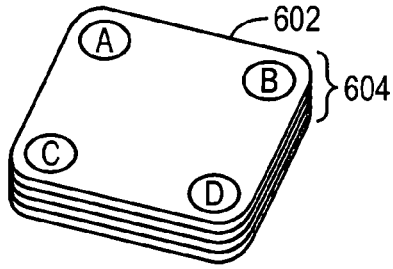

FIG. 6 depicts a plate type heat exchanger 602. The plate type heat exchanger 602 includes one or more plates 604 that form two sets of channels. Input manifold A and outlet manifold B communicate with one set of channels. Input manifold D and outlet manifold C communicate with a second set of channels. Packing may be placed in one or more of the inlet manifolds A or D to form flow distributors in the manifolds A or D. Optionally, packing may also be used in the outlets of at least one flow stream. Use of packing at the outlet may reduce the required refrigerant charge and minimize or eliminate liquid refrigerant storage.

FIG. 5 is a simplified cross-sectional view showing only the flow from A to B (FIG. 6, corresponding to flow from inlet 502 to outlet 508 of FIG. 5) through channel 504. Flows in the reverse direction from D to C through channel 506 would be similar. Plate heat exchangers having plates of complex shapes to provide the requisite flows are well known, and examples of commercial products are cited above. As can be seen from the schematic view of FIG. 6, such a heat exchanger of FIG. 5 implements a counterflow heat exchange, with one flow proceeding from left to right in channel 504 of FIG. 5 (and from inlet A to outlet B of FIG. 6); and an opposite flow proceeding from right to left in channel 506 (and from inlet D to outlet C of FIG. 6). It should also be appreciated that the counterflow embodiments of FIGS. 5 and 6 should not be taken as limiting; and that parallel flow, cross flow, or other kinds of heat exchange may also be used in embodiments according to the invention.

The heat exchanger 602 exemplified in FIG. 6 may be used as a desuperheater exchanger for exchanging heat between a compressed refrigerant and a returning expanded refrigerant exiting a refrigeration section. The heat exchanger 602 may also be used as a condenser or an evaporator. Alternately, the heat exchanger 602 may be used as a heat exchanger for transferring heat from a compressed refrigerant to an expanded refrigerant of another refrigeration cycle. In another exemplary application, the heat exchanger 602 may be used in a refrigeration section for exchanging heat between a condensing compressed refrigerant and a returning expanded refrigerant in a refrigeration section. For example, one or more heat exchangers 602 may be used as heat exchangers 232, 236, and 240 in a refrigeration process 208 depicted in FIG. 2, as heat exchangers 302, 306, 308, and 312 of refrigeration section 318 of FIG. 3, as heat exchangers 410, 414, and 416 in refrigeration section 408 of FIG. 4, or as heat exchangers, 434, 438, and 440 in refrigeration process 432 of FIG. 4.

In an exemplary experiment, a single expansion system incorporating a 4 plate PTHX B15/4 manufactured by SWEP Inc. was tested. A multicomponent mixed refrigerant was used that included CH4/C2H4/C3H8/R142. The system employed a 3.6 cfm (6 m3/h) reciprocating hermetic compressor. The system without a flow distributor reached a minimal temperature of 190 K (QR=0 W). After installation of the packed flow distributor, the system reached a lower temperature of 170 K (QR=0 W) and at 190K had a cooling capacity of QR=300 W. In this test, the heat exchanger was used as the refrigerant-to-refrigerant heat exchanger, operating in a counterflow arrangement and receiving high pressure flow from the aftercooler; delivering high pressure refrigerant to the single expansion device; receiving low pressure refrigerant from the evaporator; and delivering low pressure refrigerant to the compressor.

Figure 7A:
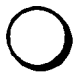
FIGS. 7A-7E depict exemplary embodiments of packing.
Figure 7B:
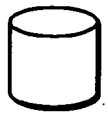
Figure 7C:
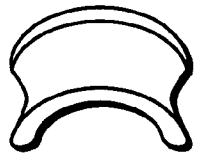
Figure 7D:
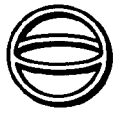
Figure 7E:
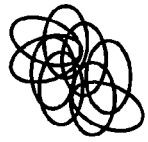

FIGS. 7A-7E depict exemplary packing for use in heat exchanger manifolds. FIG. 7A depicts an exemplary spherical ball. Alternately, ellipsoidal random packing may be used. FIG. 7B depicts an exemplary ring or cylindrical packing, such as a Raschig ring, Raschig Super ring, Cascade minirings, or PALL ring. FIG. 7C depicts an exemplary saddle packing, such as Berl saddles, Intalox ceramic saddles, Intalox metal saddles, or Koch-Glitsch Fleximax. FIG. 7D depicts an exemplary hollow spheroid packing, such as VFF Hacketten or VFF Top-Pak. In another exemplary embodiment, FIG. 7E depicts a gauze structure. Alternately, mesh pieces or perforated metal ribbon may employed. The random packing may be solid or porous and may be metal, ceramic, plastic, or similarly appropriate material, provided that the material selected is compatible with the process fluids and temperatures. In a further embodiment, structured packing may be used. The structured packing may include formed channels and be constructed with a mesh or perforated foil. In an additional exemplary embodiment, a cartridge including structured or random packing may be placed in a manifold, header, or distributor.

The expected benefit of the packing, used in an embodiment of the invention, is that it distributes flow more evenly between the parallel plates of the heat exchanger. It is expected that this benefit is achieved by creating a more homongeneous flow throughout the header region. In this case, homogeneous flow refers to the even distribution of liquid and gas flows. Mechanisms that are expected to be important in this process are an increase in the header velocity, a decrease in the hydraulic diameter, and a disturbance in the velocity flow field. The physical presence of the packing material reduces the available cross-sectional flow area. This increases the flow velocity. The packing material also reduces the flow passageways, which reduces the hydraulic diameter. The presence of packing material also disturbs the flow and creates a torturous path. This results in better mixing between liquid and vapor phases. The mixing and the physical volume occupied by the packing also reduces the potential for "pooling" of the liquid phase in the header. Since flow is reduced as traveling from the inlet (or outlet) of the header to the no flow end of the header, it may be necessary to reduce the cross-sectional area along the length of the header to maintain a sufficient velocity to ensure sufficient liquid-vapor homogeneity. However, good results were obtained with a packing comprised of balls of the same size and same packing density along the length of the header.

Preferably, the packing may, for example, be sized to provide a pressure drop of no more than about 5 psi across the heat exchanger, such as no more than about 4 psi or no more than about 2 psi, and flow velocities of no more than about 3 m/s. In general, the pressure drop across the heat exchanger will increase with velocity and with increase in the liquid fraction. In certain designs, more aggressive sizing may be allowable. In such circumstances, velocities up to 20 m/s or more and pressure drops of up to 50 psi or more may occur. Normally such high velocities and pressure drops are not desirable; however, it will be appreciated that a broad range of velocities and pressure drops (including those given) are within the scope of the invention. When the pressure drop across the header becomes significant relative to the pressure drop across the heat exchanger, there is generally flow imbalance across the heat exchanger since the flow closest to the inlet is more likely to flow across the first set of plates. For this reason small pressure drops in the header are preferred in order to realize nearly equal distribution across each plate. The random packing may also be sized such that the effective size or diameter is greater than or less than the width or diameter of the channels.

Figure 8A:
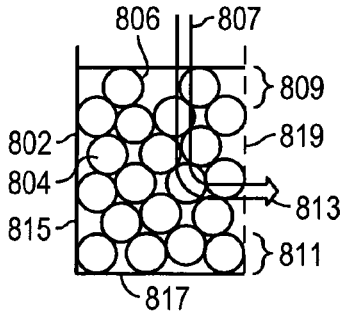
FIGS. 8A-8F depict exemplary embodiment of heat exchanger manifolds.

FIGS. 8A-8F depict exemplary embodiments of manifolds and headers. FIG. 8A depicts a manifold 802 packed with random packing 804. The packing 804 may, for example, have a diameter or size greater than that of the channels fed by the manifold. A structure 806 may secure the random packing in place. The structure 806 may, for example, be formed with a mesh, screen, or perforated foil. For example, the mesh may be a wire or polymer mesh. The foil may be a metal or plastic foil. Such structures 806 may be perforated or permeable enough to permit the flow of refrigerant fluid through structure 806. In FIGS. 8A-8F, flow arrows 807 indicate a general direction of flow of refrigerant fluid: through structure 806; into a flow end 809 of the manifold 802 and towards a non-flow end 811; and out of the header towards the heat exchanger channels, at 813. Boundaries 815, 817 are no-flow boundaries of the manifolds and headers, while structures 806 and boundaries 819 may be permeable to flow. A variety of other flow directions and flow boundary arrangements may also be used. For instance, FIGS. 8A-8F illustrate the example of flow into a header such as inlet 502 of FIG. 5, in which flow enters the top of the header and proceeds to the right into channels 504 (as indicated by arrows 807. However, in another example the flow may be for an inlet on the right of heat exchanger 500 (not shown in FIG. 5), in which flow would enter the top of the header and proceed to the left into channels 506. Alternatively, for outlet 508 for example, flow could enter from the left and exit out the top of the header. The arrangement of structure 806 and other permeable boundaries, and the no-flow boundaries, will vary depending on the direction of flow through the manifold or header. Other flow directions than those described are possible. Although the flow direction in FIGS. 8A-8F is generally indicated by an arrow, it should be appreciated that the actual flow will pass though most or all of the permeable boundaries of the header or manifold.

Figure 8B:
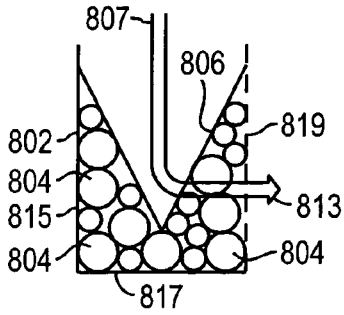

FIG. 8B depicts an alternate embodiment in which the header or manifold 802 includes a variable geometry structure 806. The variable geometry structure 806 may secure the packing 804. In the particular embodiment of FIG. 8B, the structure 806 may have a cross-sectional area that varies along the depth of the manifold. The goal with a variable geometry may be to adjust the available flow area to match the decreasing flow along the header length. Generally, at the inlet (or outlet) the flow area and the mass flow rate is at a maximum and at the end of the header the flow area and the mass flow rate are at a minimum. In one exemplary embodiment, the cross-sectional area of the structure 806 decreases along the manifold from the inlet to the non-flow end, such as an inverted cone (and, conversely, the total cross-sectional area of the packing 804 increases along the manifold from the inlet to the non-flow end). In one exemplary embodiment, the cone may be asymmetric such that the tip of the cone is offset from the center line of the manifold or header and away from the channels. In another embodiment, a series of flow channels of varying length and of the same or varying diameter are inserted inside the header to provide a plurality of inlets to the header section and, in this embodiment, the header section may contain a packing material. In yet another embodiment, the structure 806 may take the form of a cylinder. In the case of a cylindrical element, the cross sectional area does not vary but its presence results in higher velocities throughout the header. The structure 806 may be a solid element with perforations, a porous element, a mesh, or a woven fabric. The structure may be formed with metal or polymer construction.

Figure 8C:
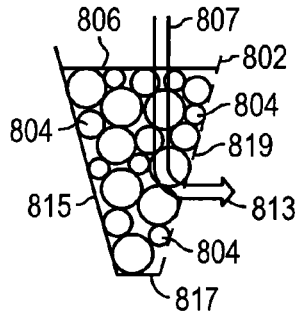

FIG. 8C depicts a variation in which the manifold has a cross-section that changes along the length of the manifold. In this exemplary embodiment, the total packing cross-section decreases along the manifold from the inlet end to the non-flow end. Structure 806 secures the packing 804. As shown, structure 806 is symmetric. However, in alternative embodiments, an asymmetric structure may be used.

Figure 8D:
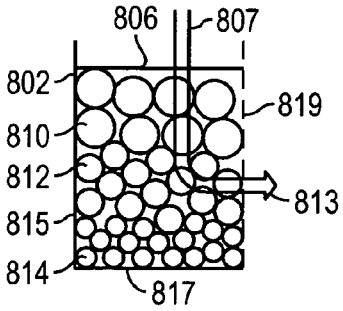

FIG. 8D depicts a manifold or header 802 in which packing of varying size (810, 812, and 814) is used. The packing is secured by structure 806. In this exemplary embodiment, the size of the packing decreases toward the non-flow end of the manifold 802. However, the different sized packing may be distributed evenly or placed such that larger packing is located nearer the non-flow end of the manifold 802. In one particular embodiment, the packing is bimodal, comprising a first size and a second size of packing. In other variations more than two sizes of packing elements are used, and in some variations two, three, or more packing geometries are used. In cases where different sizes of packing elements are used, they can be distributed in either a progressive fashion (e.g. from larger to smaller packing elements), or in a random fashion. The packing elements may also comprise multiple different sets of sizes and shapes of packing elements. Variation of packing element shape (which may be implemented by having two, three, or more different packing element shapes, which may be distributed in discrete sets, or continuously or randomly varied across the header or manifold) may also be used.

Figure 8E:
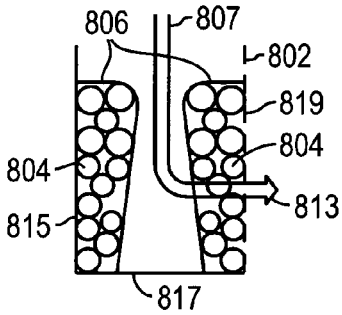
Figure 8F:
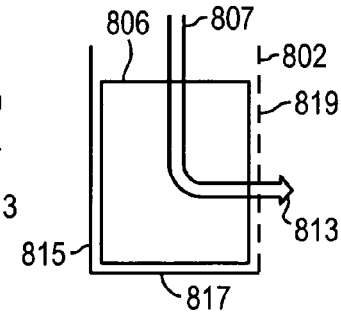

FIG. 8E depicts a further exemplary embodiment in which the structure 806 has a cross-sectional area that increases toward the non-flow end of the manifold 802 (and, conversely, the total cross-sectional area of the packing decreases toward the non-flow end of the manifold 802). (It should be noted that the arrangement of FIG.8E does not have the preferred relationship of a decreasing flow area towards the no flow end of the manifold; but it is presented for the sake of illustrating variations). In an alternative embodiment of FIG.8E the area between the two sides, shown in FIG. 8E as blank space, may be filled with a solid barrier. In that case, flow is through the structure 806, and the cross sectional area of flow through the packing material 804 is therefore reduced towards the non-flow end of the manifold. FIG. 8F depicts an exemplary embodiment in which a cartridge 806 is inserted into the manifold 802. The cartridge 806 may for example, include or house random packing. Alternately, the cartridge 806 may be formed with structured packing.

Other variations than those shown in FIGS. 8A-8F may also be used. For example, the packing may include a solid element or a porous element surrounded by other packing material. Also, the geometry of the packing, or a solid or porous element within the packing, or the basic packing itself, may vary in a smooth continuous fashion, in a wavy fashion, or in a step-wise fashion; and may be either symmetric or asymmetric. The effective reduction in cross-sectional flow area by the structure may result in a linear or a nonlinear change in flow area.

Figure 9A:
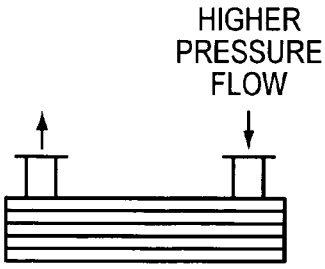
FIGS. 9A-9C depict exemplary orientations of heat exchangers.
Figure 9B:
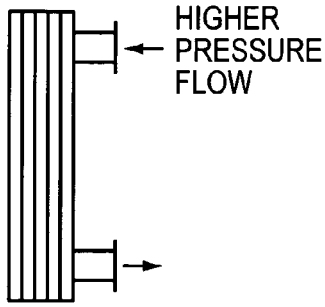
Figure 9C:
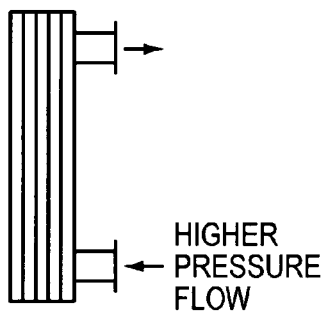

FIGS. 9A, 9B, and 9C depict exemplary orientations of the heat exchangers. FIG. 9A depicts a horizontal heat exchanger. FIG. 9B depicts a heat exchanger with the warm end up. In an exemplary refrigeration section, the compressed refrigerant inlet manifold is located above the compressed refrigerant outlet manifold and the expanded refrigerant inlet manifold is located below the expanded refrigerant outlet manifold in a counter-flow heat exchanger. FIG. 9C depicts an alternate embodiment in which the warm end is located near the bottom of the heat exchanger and the manifolds are arranged accordingly.

The heat exchanger may be operated in different orientations. In one exemplary embodiment, the tested heat exchanger was installed with a "warm end" up, and then turned 180° to the position "warm end" down. These regimes are presented in Table 1 as No. 3 and 4 respectively. The system demonstrated a good stability of operation.

TABLE 1

Comparative performance of the system without and with flow distributor for PTHX B15/4 from Swep Inc.

| No | $P_H$, at | $P_L$, at | $Q_R$, W | $T_R$, K - out Evaporator | MR flow rate Mole/s | MR comp. Mole % $CH_4/C_2H_4/C_3H_8$/R-142b |
|---|---|---|---|---|---|---|
| 1-1-w/out FD | 21.2 | 2.7 | 310 | 216 | 0.077 | 29/31/21/19 |
| 1-2-w FD | 22.7 | 2.9 | 297 | 205 | 0.090 | 30/30/22/17 |
| 1-3-w/e up | 23.0 | 2.9 | 287 | 200 | 0.090 | 30/33/23/14 |
| 1-4-w/e down | 22.9 | 3.2 | 289 | 203 | 0.100 | 35/33/21/11 |

Referring to Table 1, the refrigeration cycle using a heat exchanger with flow distributors (Rows 2, 3, and 4) exhibited lower evaporator temperatures than the refrigeration cycle that used heat exchanger (Row 1) without a flow distributor. The refrigeration cycle with a heat exchanger having the "warm end" up (Row 3) exhibited a lower temperature in the evaporator than the refrigeration cycle having a heat exchanger having the "warm end" down (Row 4).

Figure 10:
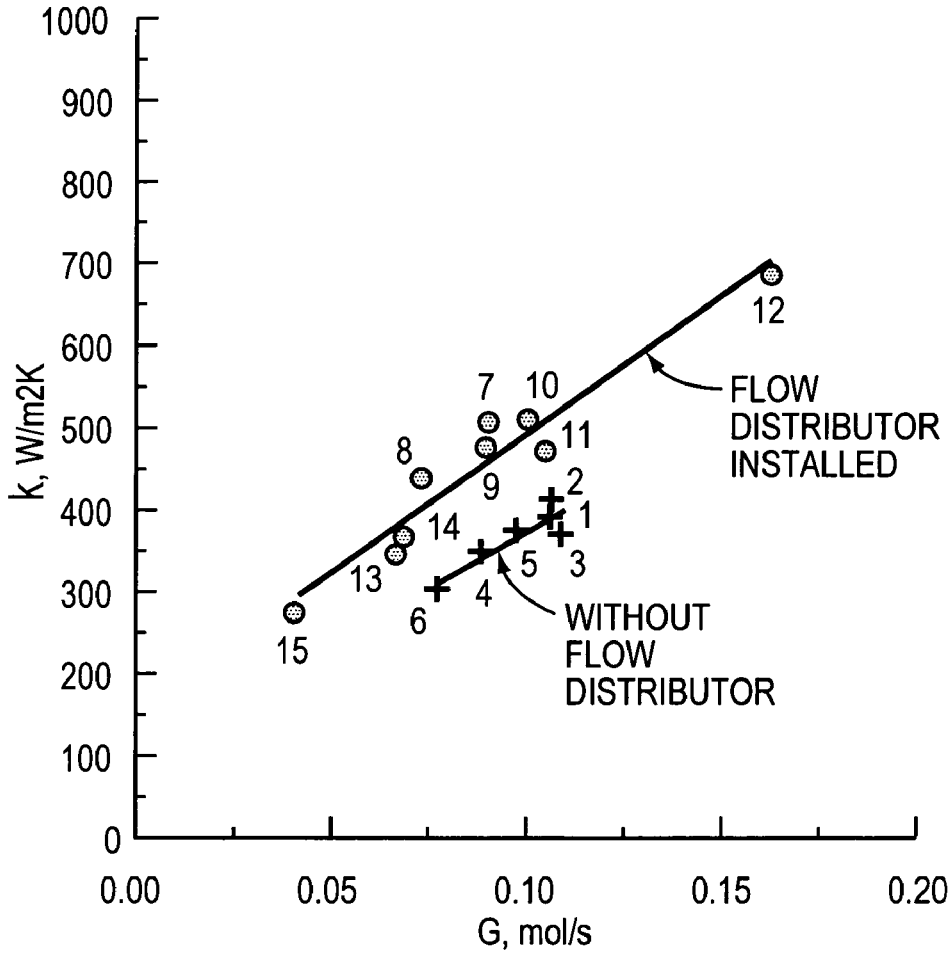
FIG. 10 illustrates performance characteristics for heat exchangers with and without a packed distributor.

Efficiency of a packed flow distributor according to an embodiment of the invention can be seen in FIG. 10, which presents an overall heat transfer coefficient (HTC or k, W/m2-K) with and without a flow distributor for plate type heat exchangers operating with hydrocarbon mixtures. The results were calculated from additional experiments using a single-stage refrigeration system operating at refrigeration temperature of 190 K. A heat load of the heat exchanger was determined based on the measured flow rate of the mixed refrigerant and temperature and pressure values at the heat exchanger inlet and outlet. Soave equation of state was used to determine enthalpy at the inlet and outlet of the heat exchanger flows. An average temperature difference was calculated.

Further experimental data on the four-plates plate type heat exchanger efficiency operating with hydrocarbon-based mixed refrigerant-hydrocarbon (HC): CH4/C2H4/C3H8 and R-142b with the components content (mole %) being 41/32/20 and 7 respectively is presented in Table 2. Table 2 also includes data for mixed refrigerant based on Ar and halocarbons (AR/R) R14, R23, R134a, R142b. Composition in mole % was measured as following: 7/41/30/12/10 with 1% of accuracy. The data demonstrates a high efficiency of the plate type heat exchanger with the proposed flow distributor with different mixed refrigerants. Table 2 also shows test data for a six plate heat exchanger operating with a hydrocarbon (HC) mixed refrigerant blend comprising CH4/C2H4/C3H8/C4H10, with the components' content being 34/33/17/15 (mole %) respectively. The results indicate an improvement of about 20-30% in efficiency. Actual performance will vary. However, even heat exchanger efficiency improvements of 2% or less due to the use of this invention will be deemed to be within its scope. It should also be appreciated that, although specific refrigerant blends and types of refrigerants are mentioned herein, embodiments according to the invention may be used with all two phase refrigerant and refrigerant-oil mixtures. Further, since most refrigeration systems circulate compressor oil along with refrigerant it is expected that the invention will also have utility with oil and oil-rich liquid phases.

TABLE 2

Performance of a single-stage system based on 3.6 cfm compressor-both four and six plate heat exchangers, including a flow-distributor according to the invention.

| # | $Q_R$, W | $T_R$, K | $G_{MR}$, Mole/s | HTC, W/m$^2$/K | $DT_{AV}$, K | $P_H$, at | $P_L$, at | MR | Plates Number |
|---|---|---|---|---|---|---|---|---|---|
| 2-1 | 156 | 223 | 0.090 | 514 | 15.5 | 21.3 | 3.0 | HC | 4 |
| 2-2 | 100 | 209 | 0.096 | 547 | 20.5 | 19.5 | 3.0 | HC | 4 |
| 2-3 | 51 | 182 | 0.103 | 621 | 27.6 | 18.1 | 3.0 | HC | 4 |
| 2-4 | 0 | 173 | 0.106 | 721 | 28.9 | 16.0 | 3.0 | HC | 4 |
| 2-5 | 186 | 197 | 0.130 | 947 | 24.4 | 21.3 | 4.3 | AR/R | 4 |
| 2-6 | 173 | 193 | 0.102 | 889 | 25.4 | 21.0 | 4.0 | AR/R | 4 |
| 2-7 | 231 | 194 | 0.156 | 671 | 21.2 | 23.8 | 3.0 | AR/R | 4 |
| 2-8 | 184 | 190 | 0.125 | 442 | 19.4 | 19.0 | 3.4 | HC | 6 |

TABLE 2-continued

| # | $Q_R$, W | $T_R$, K | $G_{MR}$, Mole/s | HTC, W/m²/K | $DT_{AV}$, K | $P_H$, at | $P_L$, at | MR | Plates Number |
|---|---|---|---|---|---|---|---|---|---|
| Performance of a single-stage system based on 3.6 cfm compressor-both four and six plate heat exchangers, including a flow-distributor according to the invention. | | | | | | | | | |
| 2-9 | 219 | 190 | 0.095 | 370 | 17.5 | 20.2 | 2.9 | HC | 6 |
| 2-10 | 202 | 192 | 0.06 | 295 | 16.2 | 22.7 | 2.3 | HC | 6 |

Efficiency of the tandem operation is shown in Table 3. In this test, two plate type heat exchangers were connected in series to provide the functional equivalent of a single heat exchanger. A flow distributor according to an embodiment of the invention allows an efficient plate type heat exchanger operation with two-phase vapor-liquid flow of the mixed refrigerant at the inlet. A relatively high Carnot efficiency (CEF), greater than about 0.10, of a small-scale cooler based on a 3.6 cfm compressor, was demonstrated as shown in Table 3. A short-pass plate type heat exchanger B15/6 was installed to operate in a relatively high temperature range.

TABLE 3

| MR-HC composition, % | $Q_R$, W | $P_{CM}$, W | $T_R$, K | $P_D$, at | $P_{SC}$, at | Carnot Eff. CEF |
|---|---|---|---|---|---|---|
| Performance of the system operating with plate type heat exchanger tandem. | | | | | | |
| 50/22/17/15 | 63.5 | 670 | 131 | 16.4 | 1.50 | 0.12 |
| 57/19/14/10 | 60.7 | 627 | 139 | 24.4 | 1.70 | 0.11 |

Another series of tests was conducted on a two-stage (single phase separator) auto-cascade low temperature refrigeration system having a 24 cfm displacement compressor. A mixed refrigerant was used that included the following components: Ar/R14/R23/R125/R236fa. A SC-12 5"×12" (50 plates SubCooler) plate type heat exchanger manufactured by FlatPlate, Inc. with an "orifice" type distributor was initially selected. The pressure drop of the distributor located at the inlet of the high pressure (280-300 psig) flow was 8-10 psi. When the distributor was relocated to the suction side (30-50 psig) side of the plate type heat exchanger, the heat exchanger caused 16-18 psi pressure drop.

The SC-12 was replaced with a similar size C4A 5"×12" (44 plates Condenser) plate type heat exchanger. The inlet headers of the C4A did not have a factory installed header. Instead, the inlet header was modified by installing a packing that consisted of ⅜" stainless steel balls. A sheet of perforated metal formed in a disk shape was placed at the top of the header to retain the ball bearings in the header. The disk diameter was larger than the inner diameter of the connecting tubing, and larger than the header throat. This allowed the tubing to secure the perforated metal disk to be held in place by the tubing. The overall pressure drop measured on the supply side of the heat exchanger was 2-3 psi, and on the return side 3-5 psi. The overall heat transfer coefficient increased from 200 W/(m^2_K) to 300 W/(m^2_K).

A heat exchanger according to an embodiment of the invention with packed distributors located in one or more of the inlet manifolds may be used in the construction of refrigeration systems. A method for manufacturing a refrigeration system may include inserting a packed distributor or packing in a manifold of a heat exchanger associated with the refrigeration system. Existing refrigeration systems may also be refurbished, serviced, or retrofitted by inserting a packed distributor or packing in inlet manifolds of heat exchangers associated with the refrigeration systems. These refrigeration systems may be single-component or mixed refrigerant systems. The refrigeration systems may also be compact or cabinet sized units.

Embodiments according to the invention provide the advantage of improving stability and reliability for long term operation of a refrigeration system in a particular mode by preventing accumulation of liquid refrigerant in the header of a heat exchanger. Embodiments also provide improved stability when operating in a variety of operating conditions, including during start up, cool mode, standby mode, and defrost mode, under varying thermal loads, and under other conditions.

In view of the foregoing, it would be generally desirable in the art to provide heat exchangers, refrigeration systems incorporating the same, methods for operating refrigeration systems, methods for addressing existing heat exchangers, and related technologies that offer desirable performance.

The above disclosed subject matter is to be considered illustrative, and not restrictive, and the appended claims are intended to cover all such modifications, enhancements, and other embodiments, which fall within the scope of the present invention. Thus, to the maximum extent allowed by law, the scope of the present invention is to be determined by the broadest permissible interpretation of the following claims and their equivalents, and shall not be restricted or limited by the foregoing detailed description.

This invention was developed for the purpose of improving the heat exchanger efficiency as applied to a refrigeration process. It is anticipated that this invention can be effectively used in other heat exchanger applications such as industrial heat transfer, power plants, heat recovery units, solar energy and other alternative energy systems, and chemical petroleum operations.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method of servicing a very low temperature mixed refrigerant refrigeration system, the method comprising:

inserting discrete packing elements into a manifold of a heat exchanger associated with the refrigeration system, the heat exchanger comprising the manifold and a heat transfer channel, the heat transfer channel configured to receive fluid passing through the manifold and the discrete packing elements, the fluid being a mixed refrigerant fluid comprising at least two phases including a vapor and a liquid phase, the mixed refrigerant fluid having a temperature in the very low temperature range.

2. The method of claim 1, wherein the discrete packing elements comprise random packing elements.

3. A method of manufacturing a very low temperature mixed refrigerant refrigeration system, the method comprising:

inserting discrete packing elements into a manifold of a heat exchanger associated with the refrigeration system, the heat exchanger comprising the manifold and a heat transfer channel, the heat transfer channel configured to receive fluid passing through the manifold and about the discrete packing elements, the fluid being a mixed refrigerant fluid comprising at least two phases including a vapor and a liquid phase, the mixed refrigerant fluid having a temperature in the very low temperature range.

4. The method of claim 3, wherein the discrete packing elements comprise random packing elements.

5. The method of claim 3 , further comprising: coupling a compressor to the heat exchanger.

6. The method of claim 5, wherein the heat exchanger performs as a heat exchanger selected from the group consisting of a desuperheater, a condenser, a heat exchanger that exchanges heat between at least two refrigerant streams, and an evaporator.

7. The method of claim 5, wherein the heat exchanger comprises a component in a refrigeration section of the refrigeration system.

8. The method of claim 7, wherein the refrigeration section comprises a separator.

9. The method of claim 5, wherein the heat exchanger is a plate type heat exchanger.

10. The method of claim 5, wherein the heat exchanger is horizontally oriented.

11. The method of claim 5, wherein the heat exchanger is vertically oriented.

12. The method of claim 5, wherein the heat exchanger is vertically oriented with a warm end up.

13. The method of claim 3, wherein inserting the packing into the manifold comprises inserting a cartridge into the manifold.

14. The method of claim 13, wherein the cartridge comprises structured packing.

15. The method of claim 13, wherein the cartridge comprises random packing.

16. The method of claim 3, wherein inserting the packing into the manifold comprises using a structure to secure the packing in place.

17. The method of claim 16, wherein the structure is sufficiently permeable to permit the flow of refrigerant fluid.

18. The method of claim 16, wherein the structure is selected from a group consisting of a mesh, a screen and a perforated foil.

19. The method of claim 16, wherein the structure is selected from a group consisting of a wire mesh, a polymer mesh, a metal foil and a plastic foil.

20. The method of claim 16, wherein the structure comprises a structure selected from a group consisting of a variable geometry structure, a cylindrical structure, a symmetric structure, an asymmetric structure, and a structure of varying cross-sectional area along the manifold from an inlet of the manifold to a non-flow end of the manifold.

21. The method of claim 3, wherein the packing comprises packing of varying size.

22. The method of claim 3, wherein the packing comprises packing elements including spherical balls.

23. The method of claim 3, wherein the packing comprises packing elements selected from the group consisting of spherical elements, ellipsoidal elements, ring elements, cylindrical elements, saddle elements, spheroid elements, ribbon elements, and gauze elements.

24. The method of claim 3, wherein the packing comprises packing elements having at least two size modes, the packing elements comprising at least a first set of packing elements having a first size mode and a second set of packing elements having a second size mode different from the first size mode.

25. The method of claim 1, wherein the heat exchanger performs as a heat exchanger selected from the group consisting of a desuperheater, a condenser, a heat exchanger that exchanges heat between at least two refrigerant streams, and an evaporator.

26. The method of claim 1, wherein the heat exchanger comprises a component in a refrigeration section of the refrigeration system.

27. The method of claim 26, wherein the refrigeration section comprises a separator.

28. The method of claim 1, wherein the heat exchanger is a plate type heat exchanger.

29. The method of claim 1, wherein the heat exchanger is horizontally oriented.

30. The method of claim 1, wherein the heat exchanger is vertically oriented.

31. The method of claim 1, wherein the heat exchanger is vertically oriented with a warm end up.

32. The method of claim 1,wherein inserting the packing into the manifold comprises inserting a cartridge into the manifold.

33. The method of claim 32, wherein the cartridge comprises structured packing.

34. The method of claim 32, wherein the cartridge comprises random packing.

35. The method of claim 1, wherein inserting the packing into the manifold comprises using a structure to secure the packing in place.

36. The method of claim 35, wherein the structure is sufficiently permeable to permit the flow of refrigerant fluid.

37. The method of claim 35, wherein the structure is selected from a group consisting of a mesh, a screen or a perforated foil.

38. The method of claim 35, wherein the structure is selected from a group consisting of a wire mesh, a polymer mesh, a metal foil and a plastic foil.

39. The method of claim 35, wherein the structure comprises a structure selected from a group consisting of a variable geometry structure, a cylindrical structure, a symmetric structure, an asymmetric structure, and a structure of varying cross-sectional area along the manifold from an inlet of the manifold to a non-flow end of the manifold.

40. The method of claim 1, wherein the packing comprises packing of varying size.

41. The method of claim 1, wherein the packing comprises packing elements including spherical balls.

42. The method of claim 1, wherein the packing comprises packing elements selected from the group consisting of spherical elements, ellipsoidal elements, ring elements, cylindrical elements, saddle elements, spheroid elements, ribbon elements, and gauze elements.

43. The method of claim 1, wherein the packing comprises packing elements having at least two size modes, the packing elements comprising at least a first set of packing elements having a first size mode and a second set of packing elements having a second size mode different from the first size mode.

* * * * *